United States Patent [19]

Duperon

[11] Patent Number: 4,709,804

[45] Date of Patent: Dec. 1, 1987

[54] SELF-CLEANING TRASH RACK

[75] Inventor: Terry L. Duperon, Saginaw, Mich.

[73] Assignee: Duperon Corporation, Saginaw, Mich.

[21] Appl. No.: 785,560

[22] Filed: Oct. 7, 1985

[51] Int. Cl.[4] ..... B65G 19/00

[52] U.S. Cl. ..... 198/719; 198/726; 198/732; 210/158; 210/160; 210/413

[58] Field of Search ..... 198/719, 726, 732, 733; 210/158, 159, 160, 413, 162

[56] References Cited

U.S. PATENT DOCUMENTS

| | | | |
|---|---|---|---|
| 124,130 | 2/1872 | Grier | 198/726 |
| 255,510 | 3/1882 | Hooton | 198/726 |
| 1,752,577 | 4/1930 | Ryder | 198/726 |
| 2,684,157 | 7/1954 | Tolman | 210/159 |
| 2,780,343 | 2/1957 | Bunnell | 198/732 |
| 3,209,526 | 10/1965 | Morrow | 198/733 X |
| 3,599,795 | 8/1971 | Worlidge | 210/413 |
| 4,138,340 | 2/1979 | Suzuki et al. | 210/159 X |

*Primary Examiner*—Joseph E. Valenza
*Assistant Examiner*—Jonathan D. Holmes
*Attorney, Agent, or Firm*—Learman & McCulloch

[57] ABSTRACT

A self-cleaning trash rack for removing debris from a stream of water has an upright frame positioned in the path of trash carried by the stream and a plurality of endless, flexible chains carrying trash supports which engage and carry debris on the upstream side of the frame upwardly for disposal. Each chain has sufficient slack to enable any trash support on the upstream side of the frame to rock in such direction as to release debris that is too heavy to be carried upwardly by such trash support.

16 Claims, 7 Drawing Figures

SELF-CLEANING TRASH RACK

This invention relates to a self-cleaning trash rack of the kind adapted to be installed in a stream of water which flows toward a pump or other apparatus to be protected and prevent trash which could injure the pump or other apparatus from reaching the latter.

BACKGROUND OF THE INVENTION

Canals, drainage ditches, irrigation channels, and the like frequently are contaminated with debris such as the limbs of trees, tires, bottles, cans, and large blocks of ice. If such debris is permitted to enter a pump or other water treating apparatus, such apparatus could be severely damaged or ruined. It is the practice, therefore, to protect such apparatus by the provision of a rack or strainer mounted in the water upstream from the apparatus to be protected. Such a rack or strainer, however, can become so clogged with trash and other debris as to terminate or severely restrict the flow of water to the pump or other apparatus.

To minimize the effects of rack clogging, it has been customary to provide a cleaning mechanism for stripping debris from the strainer. All of the known forms of cleaning mechanisms have bars or rods which traverse either the upstream or downstream side of the rack, engage debris collected by such rack, and carry it in a direction, usually upwardly, leading to a collection and disposal unit.

In many instances material clogging a rack is too heavy to be supported by the cleaning mechanism. In such cases, it is not unusual for the cleaning mechanism to be broken or severely damaged, thereby precluding cleaning of the rack until such time as repairs or replacements can be made. In some instances the need for repair or replacement is not detected in sufficient time to prevent flooding due to clogging of the rack.

Apparatus constructed in accordance with the invention overcomes the problems associated with trash rack cleaning mechanisms of the kind heretofore in use.

SUMMARY OF THE INVENTION

A self-cleaning trash rack constructed in accordance with a preferred embodiment of the invention comprises a generally upright frame having upper and lower drums around which is trained a plurality of closely spaced, flexible, endless strands or chains. The frame is mounted in and athwart a stream of water so that one run of the chains is upstream and the opposite run is downstream. A driving mechanism is coupled to the upper drum to rotate the latter and cause the upstream runs of the chains to move upwardly.

The upstream run of each chain is accommodated between a pair of guide rails. Each chain also is provided with a plurality of trash supports, spaced longitudinally of the run, and each support has a body of such size as to be accommodated between the guide rails at the upstream side of the rack. The body of each support is coupled at its leading end to the chain so as to move with the latter. The body of each trash support includes an elongate finger which projects from the body to engage and support debris which has been collected on the upstream side of the rack.

The body of each trash support includes a transversely extending bar which spans the distance between the associated guide rails and forms a moving fulcrum about which the body may rock.

The length of each chain is such that its downstream run has sufficient slack to enable one or more of the trash supports moving upwardly on the upstream side of the rack to rock about their respective fulcrums in the event the trash engaging fingers carried by such supports engage an object which is too heavy to be supported by such fingers. The ability of each support body to rock enables its finger to move to a position in which it passes under the heavy object, thereby avoiding breaking of the finger, the support body, the chain, or the chain driving mechanism. After the finger passes the heavy object, it and its associated body rock back to their original positions, thereby enabling the finger to engage and support lighter objects and move them upwardly.

THE DRAWING

DETAILED DESCRIPTION

Figure 1:
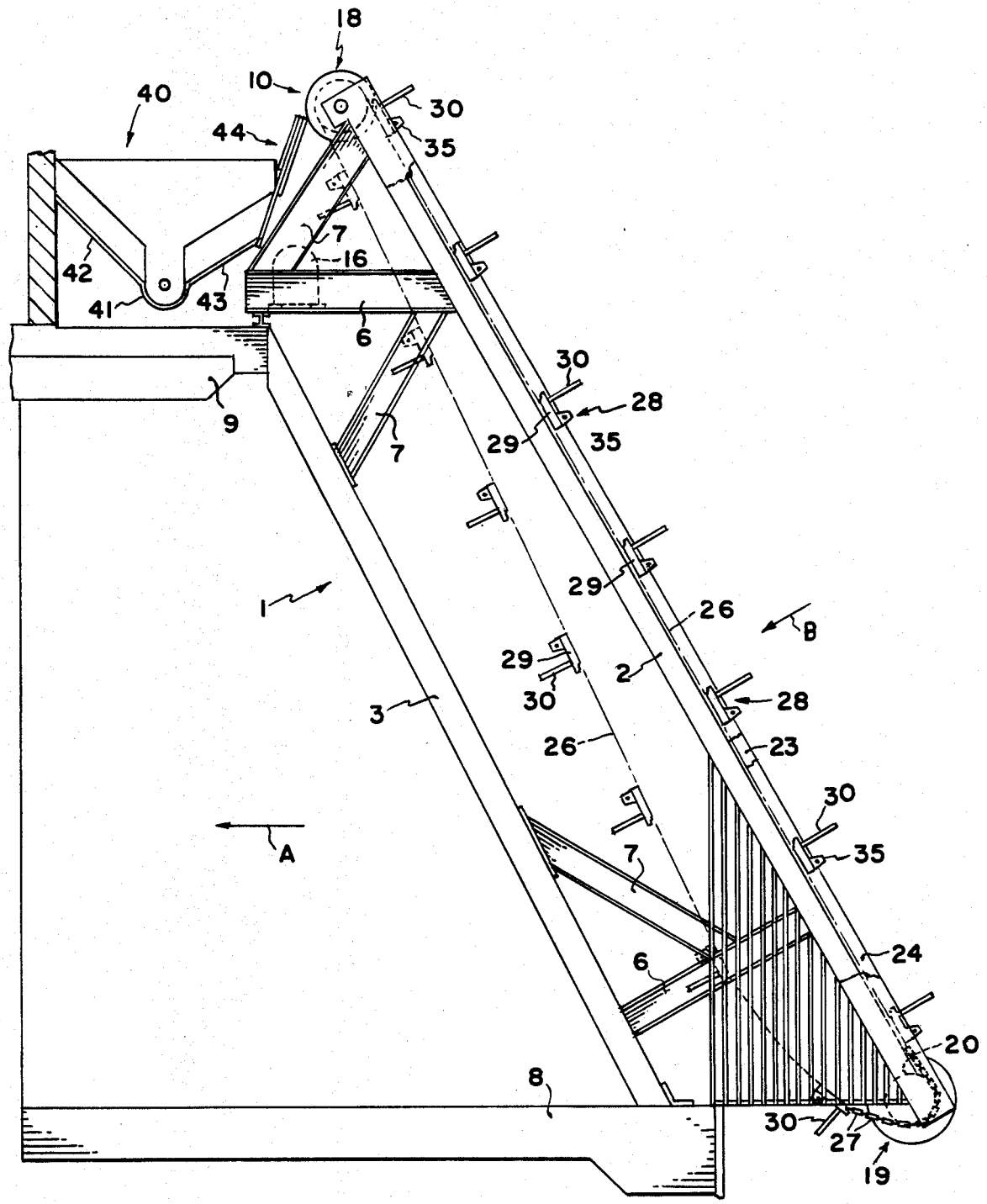
FIG. 1 is a side elevational view, partly in section, of apparatus constructed in accordance with a preferred embodiment of the invention and mounted in position for operation.

The apparatus comprises a frame 1 having spaced, parallel frame members 2 and 3 joined to one another by suitable upper and lower cross members 4 and 5, spanners 6, and braces 7. The frame 1 is adapted to be mounted in an inclined, generally upstanding position in a canal or channel through which water flows toward a pump, for example, in the direction of the arrow A in FIG. 1. The lower ends of the frame members 3 are securely fixed to a base 8 formed adjacent the bottom of the canal and have their upper ends securely fixed to a platform 9.

Journaled at the upper ends of the frame members 2 is a turning drum 10 having a shaft 11 which extends through the right-hand frame member 2 and has fixed thereto a driving sprocket wheel 12. Around the sprocket wheel is trained a chain 13 that is in driving engagement with a sprocket 14 mounted on the output shaft 15 of a transmission in a gear box 16 which is driven by an electric motor 17. Fixed on the shaft 11 for rotation therewith is a plurality of driving sprockets 18 which will be described in greater detail hereinafter.

Supported by the frame members 2 at the lower end of the frame is a turning drum 19 having a fixed shaft 20 to which is secured a plurality of pairs of arcuate guide flanges 21 and 22 which are coplanar with the sprockets 18 of the upper drum 10. Neither the drum 19 nor the guide flanges need be rotatable, but they can be mounted for rotation if desired. In this case, however, the guide flanges should be circular rather than arcuate.

Secured to and spanning the upper and lower frame members 4 and 5, respectively, is a plurality of pairs of spaced apart guide rails 23 and 24. Each pair of guide rails forms a guide channel 25 which is in alignment with the associated guide flanges 21 and 22 and the sprockets 18. The guide rails 23, 24 project from the frame 1 in a direction upstream of the water flow and, together with the frame members 2, 4, and 5, form a trash collecting rack which lies in the path of debris carried by the stream of water.

Trained around the drums 10 and 19 is a plurality of flexible, endless strands 26 each of which forms coplanar upstream and downstream runs. Each strand preferably comprises a chain having a plurality of endless links 27, alternate ones of which lie in mutually normal planes. Fixed to each of the chains in uniformly spaced apart relation is a plurality of trash support members 28 each of which comprises a metal body 29 of such width as slideably to be accommodated in the associated guide channel 25. Each support 28 also includes a metal rod or finger 30 which extends through an opening 31 in the body 29 adjacent the leading end of the latter. That end of the finger 30 which extends through the opening 31 is provided with a threaded bore in which is accommodated a correspondingly threaded shank 32 of a headed coupling bolt 33 which thus secures the member 28 to a link 27 of the chain 26.

Figure 5:
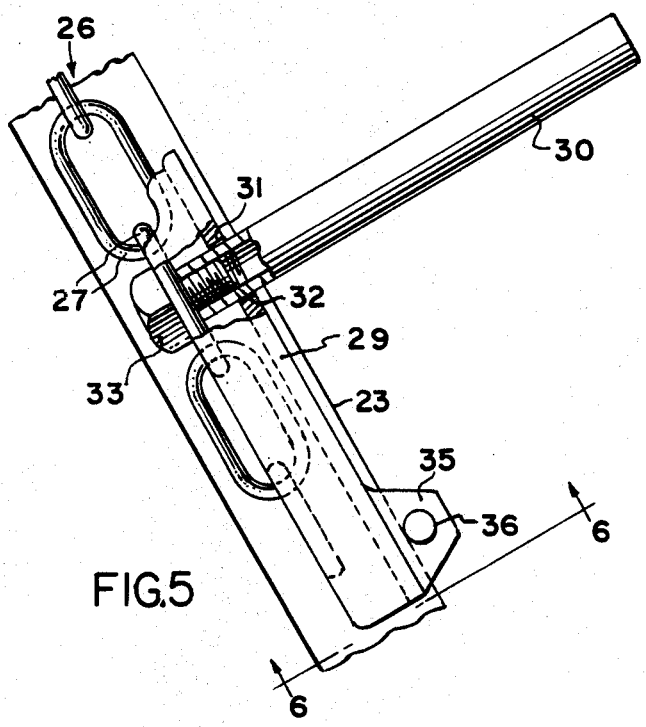
FIG. 5 is a fragmentary, greatly enlarged, side elevational view, with parts broken away, of a trash support.
Figure 6:
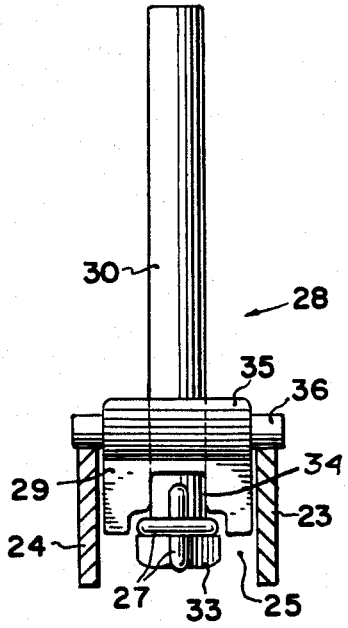
FIG. 6 is a sectional view taken on the line 6—6 of FIG. 5.

As is indicated in FIGS. 5 and 6, the link 27 to which the member 28 is secured is one whose plane substantially parallels the adjacent flat surface of the body 29. To enable all similarly oriented links to lie flush against the adjacent surface of the body 29, the latter is provided with a longitudinally extending groove 34 which is of such width and depth as freely to accommodate a portion of the alternate links 27.

As is best shown in FIG. 5, the thickness of each body 29 is less than the height of the guide rails 23, 24, the arrangement being such that most of the upstream side of the rails 23, 24 projects beyond the body 29. However, each body is provided with a tongue 35 at its trailing end which extends above or beyond the rails 23, 24. The tongue of each body 29 is equipped with a transverse bar 36 which spans and rests upon the rails 23, 24 (FIG. 6), the purpose of which will be explained hereinafter.

Figure 2:
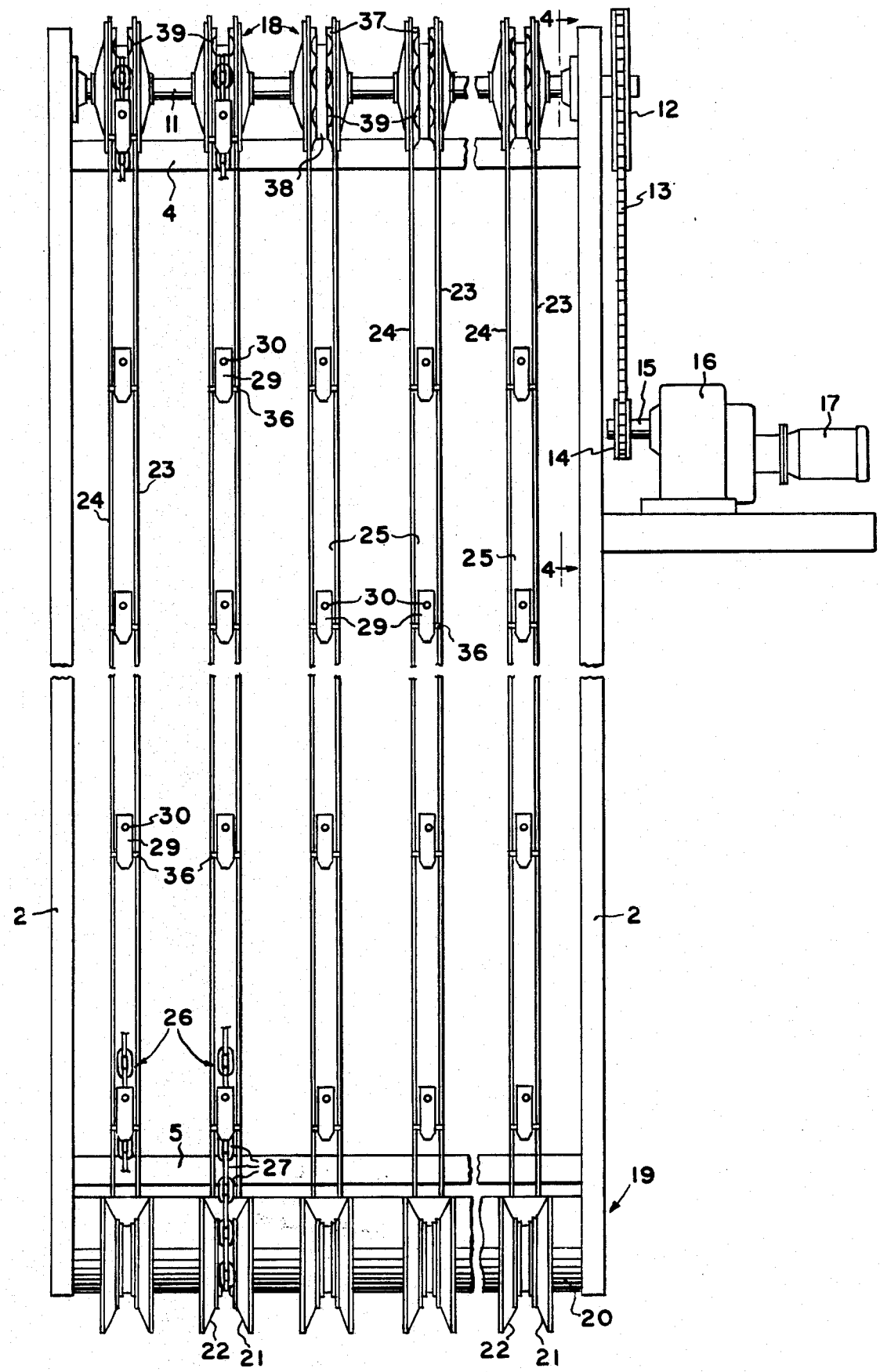
FIG. 2 is a fragmentary elevational view on an enlarged scale taken in the direction of the arrow B in FIG. 1.
Figure 3:
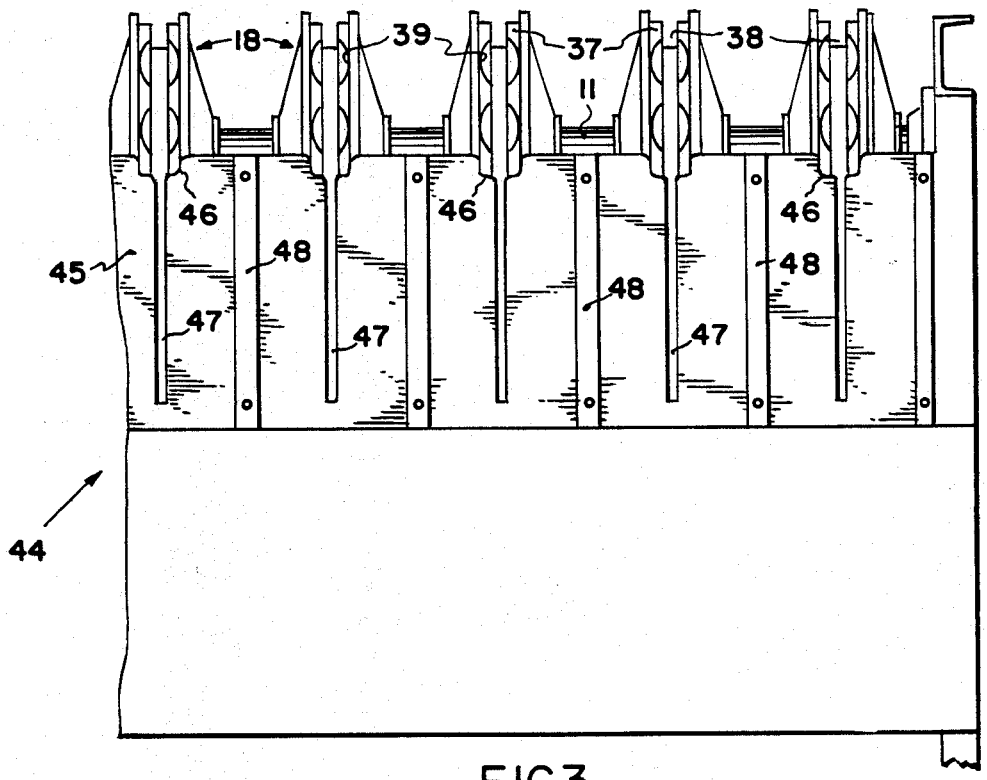
FIG. 3 is a fragmentary, elevational view of the upper end of the apparatus as viewed from a downstream position.
Figure 4:
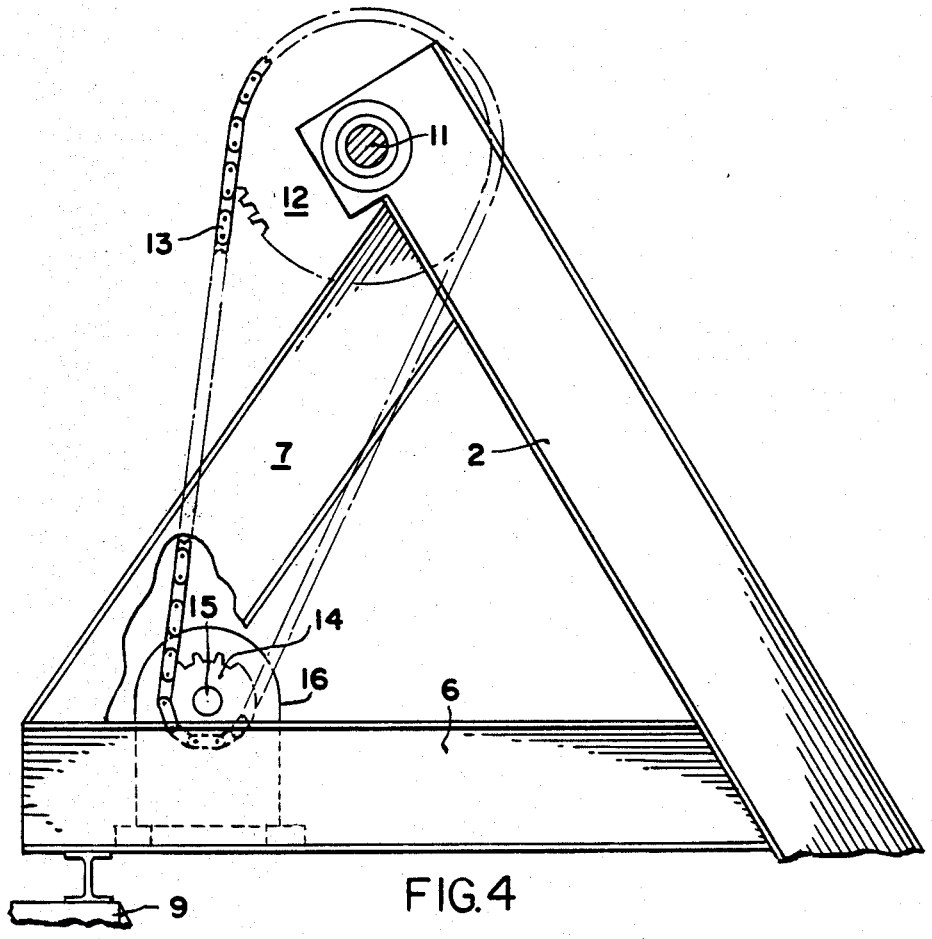
FIG. 4 is greatly enlarged sectional view taken on the line 4—4 of FIG. 2.

Each of the driving sprockets 18 has a pair of annular ribs 37 (FIG. 2) spaced by an endless groove 38. The ribs are provided with circumferentially spaced recesses 39 in which alternate ones of the chain links 27 may be accommodated so as to provide a non-slip, but easily disconnectible, driving connection between the sprockets 18 and the associated strands 26.

At the upper end of the frame 1 and supported on the platform 9 is a trash collecting and disposal trough 40 having a bottom 41 and upstanding sides 42, 43. A conveyor screw (not shown) preferably is rotably accommodated in the bottom of the trough to drive debris in the latter toward one end for discharge. The screw may be driven by a pulley (not shown) that in turn is driven from the transmission contained in the gear box 16. The trough and conveyor screw are not essential components of the invention.

At the downturn side of the upper turning drum 10 and between the latter and the trough 40 is a cleaning member 44 for stripping debris from the chains 26 and the trash supporting members 28. The member 44 comprises an elongate strip 45 of flexible, resilient material, such as rubber or a rubber substitute, having notches 46 and vertical slots 47 in register with the chains 26. Metal stiffeners 48 are secured to the member 44 between adjacent slots. The notches 46 accommodate the trash supports 28 and the slots 47 accommodate the fingers 30 as the members 28 commence their downward movement and remove any trash which may be inclined to cling to the bodies 29 or the fingers 30.

To commence operation of the apparatus the drive motor 17 is started to effect rotation of the upper turning drum 10 and each of the sprockets 18 at a slow speed, such as 2–4 r.p.m., so that the upstream run of each chain 26 moves slowly upwardly from the lower turning drum 19. Each trash support 28 on the upstream run of a chain thus also will travel upwardly. Debris which has collected adjacent the upstream side of the frame will be engaged by the fingers 30 of the supports 28 and carried upwardly toward the upper turning drum 10 for discharge into the trough 40 (if the latter is present) or to some other disposal unit.

The length of each chain 26 is the same, but each chain is substantially greater in length than twice the distance between the turning drums 10 and 19. Since each chain is driven from the upper turning drum, and since each support 28 is supported by the rails 23 and 24 during its upward movement, the upstream run of each chain is taut. The downstream run, however, is slack.

Figure 7:
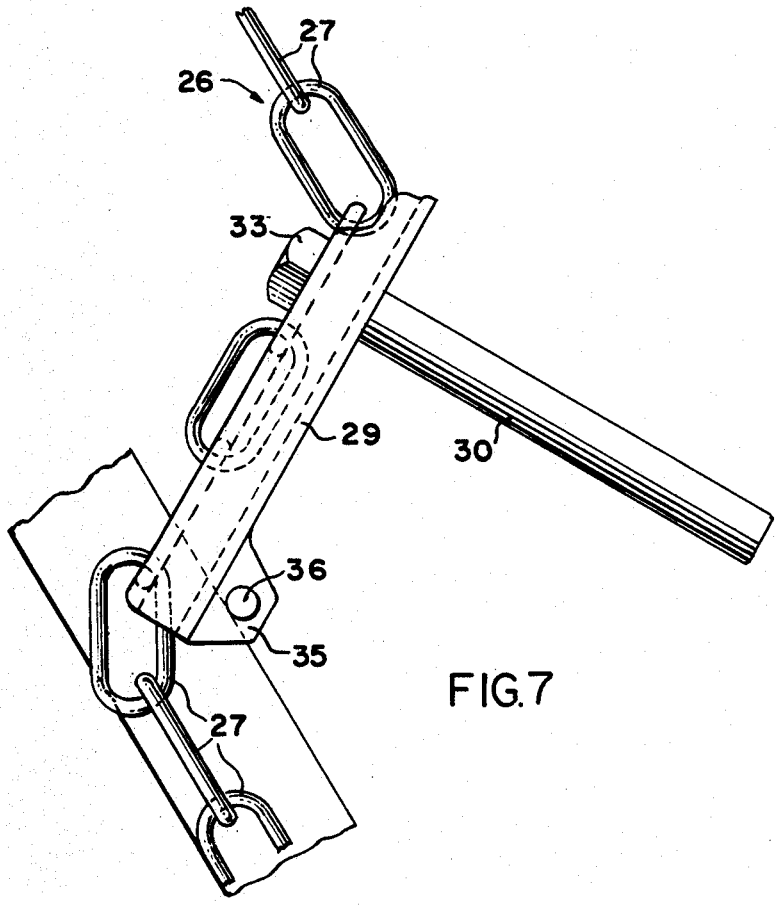
FIG. 7 is a view similar to FIG. 5, but illustrating the trash support in a rocked position.

Should the weight of debris engaged by a finger 30 on a trash support 28 be too great to be transported upwardly, the body 29 of such trash support may pivot or rock clockwise, as viewed in FIG. 5, about the fulcrum formed by the pin 36 to the position shown in FIG. 7 in which the finger 30 is inclined downwardly and thus is unable to continue its support of the heavy debris. Accordingly, the finger may slide from beneath the debris as the support 28 continues its upward movement. Once the finger clears the heavy debris, the support returns to the position shown in FIG. 5. Since some part of the body 29 remains at all times between the guide rails 23, 24, each body rocks in the plane of the runs of its associated chain.

Each support 29 may rock to a position in which its finger 30 can pass beneath an obstacle because of the slack in the downstream run of the associated chain and because such chain may slide relative to the lower turning drum 19 as the support body 28 rocks about its fulcrum. Since the chains are slideable relative to the lower turning drum, it is not necessary that any part of the latter be rotatable.

As each support 28 commences the transition from the upper run to the lower run of the associated chain, the body may rock about the connections of its leading end to the chain so that its trailing end moves relative to the chain in a counterclockwise direction as viewed in FIG. 5. The ability of the body of each trash support to rock in this manner reduces the diameter of the turning drum 10.

The disclosed embodiment is representative of the presently preferred form of the invention, but is intended to be illustrative and not definitive thereof. The invention is defined in the claims.

What is claimed is:

1. A self-cleaning trash rack comprising an upstanding frame inclined to the vertical; an upper turning drum rotatably mounted on said frame adjacent its upper end; a lower turning drum mounted on said frame adjacent its lower end; drive means coupled to said upper drum for rotating the latter; a plurality of endless, transversely spaced, flexible strands trained around and spanning said drums and forming substantially coplanar upwardly and downwardly movable runs, each of said strands being of such length as to provide slack in the downwardly movable run; non-slip driving means drivingly coupling each of said strands and said upper drum for driving upwardly each of said upwardly movable runs, each of said strands being in non-driving engagement with said lower drum; a plurality of trash supports secured to each of said strands at spaced apart intervals for movement with the associated strand and in such position as to engage trash; a pair of guide rails for each of said strands carried by said frame, the guide rails of each pair thereof straddling the associated strand for guiding the upwardly movable run of said strand and the trash supports secured thereto; and means carried by each of said trash supports for slideable engagement with the associated guide rails to support the upwardly movable run of the associated strand and form a fulcrum overlying said upwardly movable run and about which said trash support may rock, the non-driving engagement between said strands and said lower drum and said slack enabling a trash support on the upwardly movable run to rock about said fulcrum through an arc sufficient to permit such trash support to pass by such object in response to the imposition by an object of predetermined resistance to upward movement of such trash support.

2. A rack according to claim 1 wherein each of said trash supports comprises a body interposed between a pair of said guide rails.

3. A rack according to claim 1 wherein each of said strands comprises a chain.

4. A rack according to claim 3 wherein the body of each of said trash supports has a longitudinal slot in which the associated chain is accommodated.

5. A rack according to claim 3 wherein said non-slip driving means includes a sprocket wheel for each of said chains in driving engagement therewith.

6. A rack according to claim 1 wherein said lower drum includes a pair of spaced apart flanges for each of said strands, the spacing between the flanges of each pair thereof being of such width as slideably and freely to accommodate the associated trash supports therebetween.

7. A rack according to claim 1 including cleaning means straddling each of said strands at the downwardly movable run thereof for stripping debris from said strands and the associated trash supports.

8. A rack according to claim 7 wherein said cleaning means comprises a flexible member having spaced slits therein through which said strands pass.

9. A rack according to claim 1 including trash collecting means mounted adjacent said upper drum and at its downturn side for receiving trash carried upwardly by said trash supports and over said upper drum.

10. A rack according to claim 9 including discharge means in said collecting means for discharging trash therefrom.

11. A rack according to claim 1 wherein each of said trash supports comprises a body having a leading end and a trailing end, and wherein the means forming said fulcrum is at the trailing end of said body.

12. A self-cleaning trash rack comprising an upstanding frame inclined to the vertical and having turning drums at its upper and lower ends; a plurality of pairs of guide rails spanning the upper and lower ends of said frame; a plurality of endless, flexible strands each of which is trained around said drums and each of which has a first run movably accommodated between a pair of said guide rails; non-slip driving means drivingly coupling each of said strands and the upper drum; drive means for driving said upper drum in such direction that said first run of each of said strands moves upwardly from the lower end of said frame to the upper end thereof, each of said strands being non-drivingly engaged with the lower drum, and each of said strands having a second run extending downwardly from the upper drum and having slack therein; at least one trash support for each of said strands; means mounting each of said trash supports on its associated strand for upward movement with said first run and between the associated guide rails thereby to support and move trash upwardly relative to said frame; and means carried by each of said trash supports for slideable engagement with the associated guide rails to form a fulcrum overlying the associated strand, the mounting means for each of said trash supports enabling the latter to rock about said fulcrum, the non-drivable engagement between said lower drum and each of said strands and the amount of slack in each of the second runs enabling each of said trash supports to rock about its fulcrum through an arc sufficient to enable trash which cannot be moved upwardly by such trash support to be released therefrom.

13. A rack according to claim 12 wherein each of said trash supports comprises a body accommodated between the associated pair of guide rails and a support member carried by said body and extending beyond the latter in a direction substantially normal to said first run.

14. A rack according to claim 12 wherein each trash support comprises a body having a leading end and a trailing end, and wherein said mounting means comprises a coupling connecting said body at its leading end to the associated strand.

15. A rack according to claim 14 wherein the trailing end of said body is free to move relative to the associated strand.

16. A rack according to claim 14 wherein said body has a slot in which the associated strand is accommodated.

* * * * *